US007984862B2

(12) United States Patent
Henderson et al.

(10) Patent No.: US 7,984,862 B2
(45) Date of Patent: Jul. 26, 2011

(54) RAIL ANCHOR

(75) Inventors: Jim Henderson, Atchison, KS (US); Ed Bosshammer, Atchison, KS (US); Casey Walsh, Denton, KS (US)

(73) Assignee: Amsted Rail Company, Inc., Granite City, IL (US)

( * ) Notice: Subject to any disclaimer, the term of this patent is extended or adjusted under 35 U.S.C. 154(b) by 180 days.

(21) Appl. No.: 12/459,870

(22) Filed: Jul. 10, 2009

(65) Prior Publication Data

US 2011/0006126 A1 Jan. 13, 2011

(51) Int. Cl.
*E01B 13/00* (2006.01)

(52) U.S. Cl. ..... 238/315; 238/310; 238/323; 238/327 R; 238/336; 238/351

(58) Field of Classification Search ..... 238/310, 238/283, 383, 315, 316, 317, 323, 327 R, 238/327 A, 264, 336, 338, 351, 355, 321
See application file for complete search history.

(56) References Cited

U.S. PATENT DOCUMENTS

| | | | | |
|---|---|---|---|---|
| 1,609,287 | A | 12/1926 | Blair | |
| 2,161,484 | A | 6/1939 | Preston | |
| 2,827,240 | A * | 3/1958 | Steele et al. | 238/327 R |
| 3,100,081 | A | 8/1963 | Gallagher | |
| 3,102,690 | A | 9/1963 | Fee | |
| 3,496,882 | A * | 2/1970 | Campbell et al. | 104/2 |
| 3,762,640 | A | 10/1973 | Cantwell | |
| 3,837,572 | A | 9/1974 | Van Sant | |
| 7,147,169 | B2 | 12/2006 | Walsh | |
| 7,374,110 | B2 | 5/2008 | Walsh | |
| 7,690,584 | B2 * | 4/2010 | Geissele et al. | 238/264 |

* cited by examiner

*Primary Examiner* — Mark T Le
(74) *Attorney, Agent, or Firm* — Edward J. Brosius

(57) ABSTRACT

A rail anchor and a rail anchor assembly are provided for use with a concrete railroad tie. An elastomeric plate is placed on a top surface of the railroad tie. A rigid plate is placed on top of the elastomeric plate. The rail anchor is placed adjacent the elastomeric plate and the rigid plate. The rail anchor has a first end with a receiving opening and a second end with a receiving indentation to receive edges of the flanges of the railroad rail. The rail anchor has a center portion joining the two ends. The outer portion of the rail anchor extends downwardly an amount less than the thickness of the elastomeric plate and the rigid plate to avoid contact with the concrete railroad tie.

10 Claims, 2 Drawing Sheets

RAIL ANCHOR

BACKGROUND OF THE INVENTION

In the installation and operation of railroad rail and the operation railroad engines and freight cars on such rail, the standard rail fastener is a spike driven into a wood tie on either side of the rail. Such arrangement is designed to keep the lateral spacing between rails to maintain gage distance. Tie plates are also utilized as bearing pads against lateral and vertical forces.

Special problems have arisen due to the use of concrete ties in certain railroad rail installations. The particular problem with railroad rail mounted on concrete ties is longitudinal rail movement when holding is provided with resilient fasteners. Rail anchors can be used to restrict such longitudinal rail movement, which typically occurs during the acceleration and deceleration of trains or the expansion and contraction due to temperature change. However, abrasion from the steel rail anchor against the concrete tie sides tend to erode and eventually damage the concrete tie.

Accordingly, it is an object of the present invention to provide an improved rail anchor, particularly adapted for use with concrete ties.

SUMMARY OF THE INVENTION

The present invention provides rail anchor particularly adapted for use in an application where the railroad rail is installed on concrete ties. The rail anchor is designed to protect the concrete tie from longitudinal movement of the rail and, in turn, contacting of the rail anchor with the concrete tie, due to expansion and contraction of the rail due to changing temperatures, and the acceleration and deceleration of trains.

In one embodiment, the rail anchor is a one piece, elongated steel structure having a first end bent back to form a receiving opening. A second end has a receiving indentation, and a center portion connects the first and second ends. One flange of a railroad rail is received in the receiving opening, and the second flange of the railroad rail is received in the receiving indentation. The bottom surface of the center portion of the rail anchor extends downwardly to a point less than the top of the concrete tie. Abrasion with the concrete tie due to contact with the rail anchor thereby avoided.

It is also part of the present invention to provide a rail anchor assembly which comprises a concrete railroad tie having a generally flat top surface. An elastomeric plate is placed on the top surface of the railroad tie. The elastomeric plate itself has a generally flat bottom surface and a generally flat top surface. At least one rigid plate is placed on top of the elastomeric plate. A railroad rail is placed on top of the rigid plate. A one piece rail anchor is provided which has first end bent back to form a receiving opening and second end having a receiving indentation. A center portion connects the first and second ends. One edge of a first flange of a railroad rail is received in the receiving opening, and a second edge of a second flange of the railroad rail is received in the receiving indentation of the rail anchor. The rail anchor also includes a center portion connecting the first and second ends. The center portion of the rail anchor has a bottom surface which extends downwardly an amount less than the downward extent of the generally flat bottom surface of the elastomeric plate so as to avoid contact between the rail anchor and the concrete railroad tie.

DETAILED DESCRIPTION OF THE INVENTION

Figure 1:
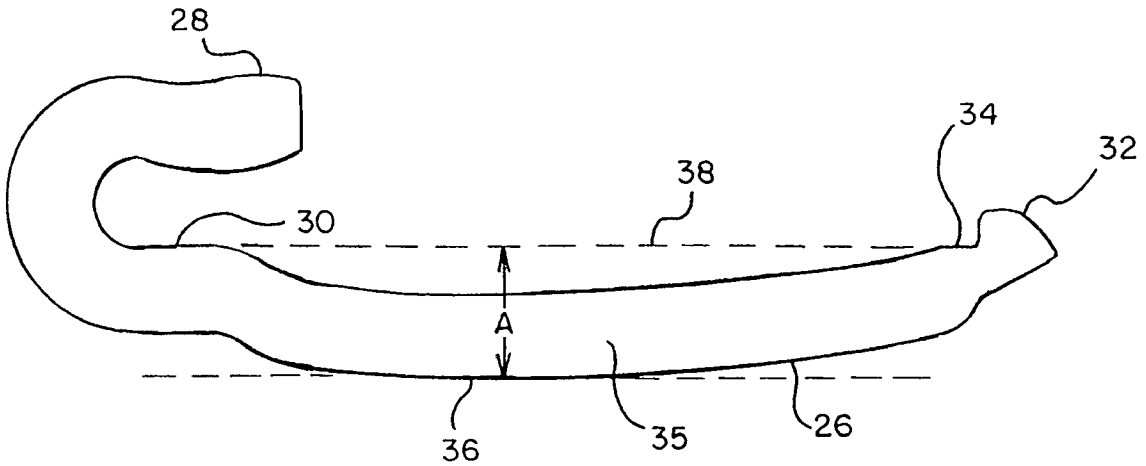
FIG. 1 is a side view of a rail anchor in accordance with an embodiment of the present invention.

Referring now to FIG. 1, a rail anchor 26 in accordance with an embodiment of the present invention is shown in a side view. Rail anchor 26 is usually comprised of steel, and is a generally elongated shape with usually a square or rectangular cross section. Rail anchor 26 includes a first end 28 which is bent back at approximately 180° to form receiving opening 30. Rail anchor 26 also comprises second end 32 which is raised and which includes receiving indentation 34 on what can be deemed the top surface of rail anchor 26. The top facing surface of receiving opening 30 and the top facing surface of receiving indentation 34 define a plane 38 which is horizontal.

Rail anchor 26 also includes a center portion 35 which joins first end 28 with second end 32. Center portion 35 of rail anchor 26 includes a bottom surface 36 which extends downwardly from plane 38 a vertical distance A, which is typically between 0.875 inches and 1.00 inches (2.2 and 2.5 cm).

Figure 2:
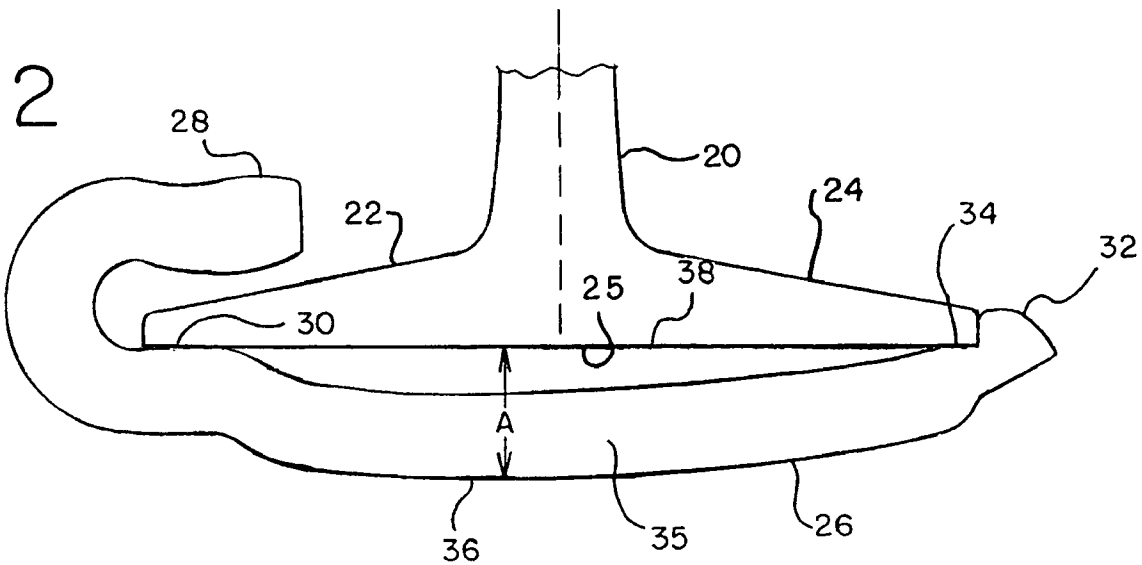
FIG. 2 is a side view of a rail anchor in accordance with an embodiment of the present invention receiving the flanges of a railroad rail.

Referring now to FIG. 2, rail anchor 26 described above in FIG. 1 is shown receiving railroad rail 20. Railroad rail 20 is seen to include a first flange 22 which extends into receiving opening 30 and is supported on the top facing surface of receiving opening 30. Railroad rail 20 is also seen to include a second flange 24 which extends into receiving indentation 34 and is supported on the top facing surface of receiving indentation 34. Railroad rail 20 is further seen to include a generally flat bottom surface 25. Bottom surface 25 is seen to extend laterally between the top facing surface of receiving opening 30 and the top facing surface of receiving indentation 34. It is also seen that bottom surface 25 of railroad rail 20 extends along plane 38 described above.

Figure 3:
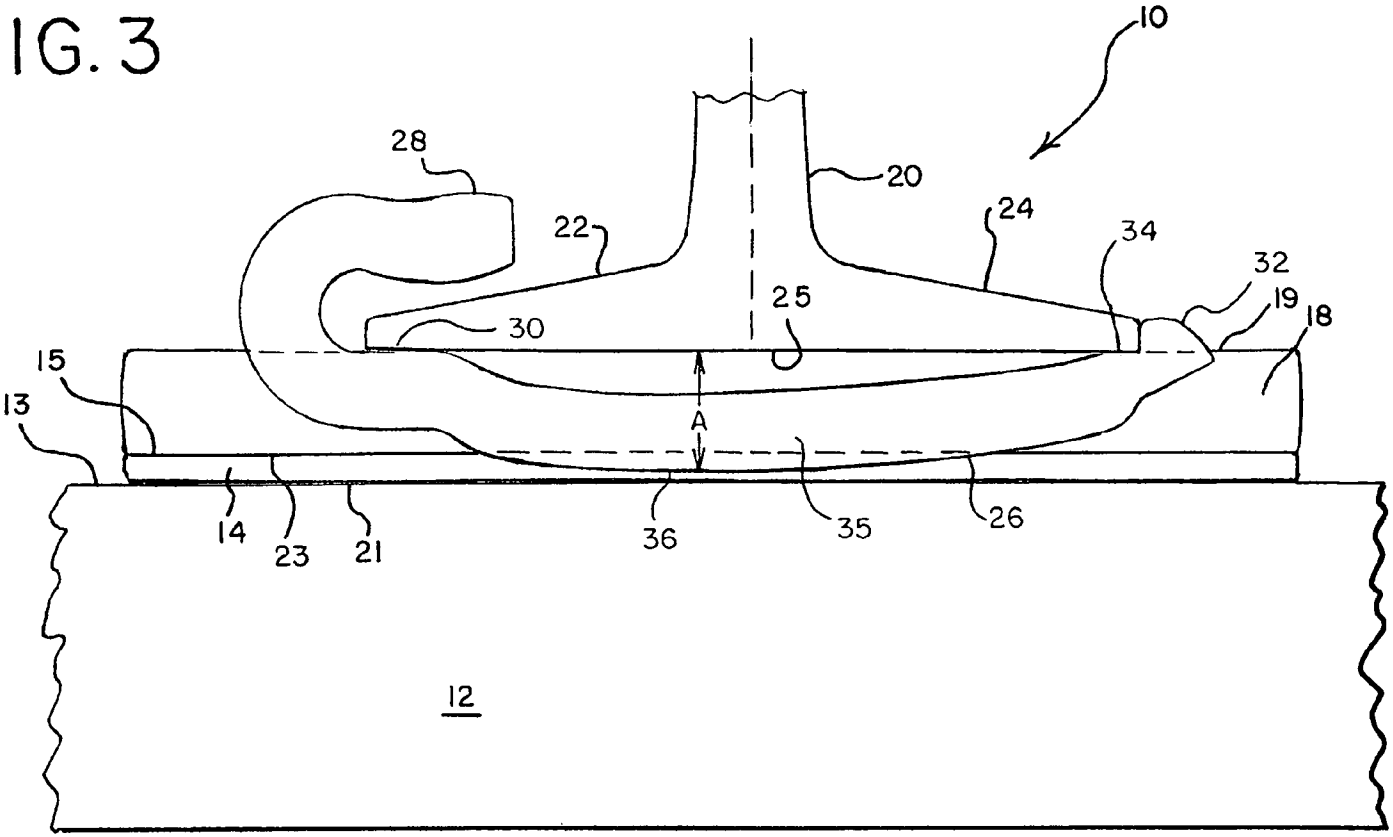
FIG. 3 is a side view, of a rail anchor assembly in accordance with an embodiment of the present invention.

Referring now to FIG. 3 of the drawings, railroad rail 20 and rail anchor 26 as described above are present as parts of rail anchor assembly 10. Rail anchor assembly 10 also includes concrete railroad tie 12. Concrete railroad tie 12 includes a generally flat top surface 13. A generally rectangular elastomeric plate 14 is placed on top surface 13 of railroad tie 12. Elastomeric plate 14 is generally comprised of a high density polymer or rubber. Elastomeric plate 14 is seen to include a generally flat top surface 15 and a generally flat bottom surface 21 which faces and is supported on top surface 13 of concrete railroad tie 12.

Rigid plate 18 is provided and is placed on top of elastomeric plate 14. Rigid plate 18 is a generally rectangular structure, usually comprised of steel, and includes a generally flat bottom surface 23 which faces and is supported on top surface 15 of elastomeric plate 14. A second rigid plate of steel can be utilized, if desired.

Railroad rail 20 includes a generally flat bottom surface 25 which is placed on top surface 19 of rigid plate 18.

It can be seen from FIG. 3 that the lowest vertical extent of bottom edge 36 of rail anchor 26 extends a distance downwardly less than the bottom surface 21 of elastomeric plate 14. Accordingly, bottom edge 36, and in fact the sides of rail anchor 26, do not contact concrete railroad tie 12. Accordingly, any abrasion by contact of rail anchor 26 with concrete railroad tie 12 is avoided.

The usual total height of elastomeric plate 14, rigid plate 18, is about 0.875 to 1.0 inches (2.2 to 2.5 cm). The distance A from plane 38 or the bottom 25 of railroad rail 20 is less than 1.15 inches (2.9 cm); accordingly, contact between rail anchor 26 and concrete railroad tie 12 is avoided.

What is claimed is:

1. A rail anchor assembly comprising a concrete railroad tie having a generally rectangular generally flat top surface, an elastomeric plate placed on the top surface of the railroad tie, the elastomeric plate having a flat bottom surface and a flat top surface and two parallel longitudinal edges, at least one generally rectangular rigid steel plate placed on the top surface of the elastomeric plate, the rigid steel plate having a flat top surface and a flat bottom surface and two parallel longitudinal edges, a railroad rail having a first flange and a second flange placed on the top surface of the rigid steel plate, and a one piece rail anchor, the one piece rail anchor comprising a first end bent back to form a receiving opening, a second end having a receiving indentation, and a center portion connecting the first and second ends, the first end receiving opening receiving an edge portion of the first flange of the railroad rail, the second end receiving indentation receiving an edge portion of the second flange of the railroad rail, the one piece rail anchor being positioned adjacent one of the longitudinal edges of the elastomeric plate and adjacent one of the longitudinal edges of the rigid steel plate, the center portion of the rail anchor arched away from a bottom surface of the rail, and a lowest bottom surface of the center portion extending downwardly an amount less than a vertical extent of the flat bottom surface of the elastomeric plate so as to avoid contact between the rail anchor and the concrete railroad tie.

2. The rail anchor assembly of claim 1 wherein the elastomeric plate is formed of a high density polymer.

3. The rail anchor assembly of claim 1 wherein the one piece rail anchor is formed of a high strength steel.

4. The rail anchor assembly of claim 1 wherein the one piece rail anchor has a generally rectangular cross section.

5. The rail anchor assembly of claim 1 wherein the rail anchor has a generally elongated structure and wherein a bottom surface of the center portion extends downwardly from the top surface of the rigid plate supporting the railroad rail no more than 1.0 inches (2.5 cm).

6. The rail anchor assembly of claim 1

Wherein an additional rigid steel plate is provided on top of the rigid steel plate.

7. The rail anchor assembly of claim 1 wherein the total thickness of the rigid steel plate and the elastomeric plate is about 1.15 inches (2.9 cm), and a bottom surface of the center portion of the rail anchor extends about 1.5 inches (3.8 cm) from the top surface of the rigid plate.

8. A rail anchor assembly comprising:

a concrete railroad tie having a generally flat top surface, a generally rectangular elastomeric plate placed on the top surface of the railroad tie, the elastomeric plate having a flat bottom surface, a flat top surface, and two parallel longitudinal edges, at least one generally rectangular rigid steel plate placed on the top surface of the elastomeric plate, the rigid steel plate having a flat top surface and two parallel longitudinal edges, a railroad rail having a first flange and a second flange placed on the top surface of the rigid steel plate, and a one piece rail anchor, the one piece rail anchor comprised of an elongated steel structure having a first end bent to form a receiving opening and a second end having a receiving indentation, and a center portion connecting the first and second ends, the first end receiving opening receiving an edge portion of the first flange of the railroad rail, the second end receiving indentation receiving an edge portion of a second flange of the railroad rail, the one piece rail anchor being positioned adjacent one of the longitudinal edges of the elastomeric plate, the center portion of the rail anchor arched away from a bottom surface of the rail, and a lowest bottom surface of the center portion extending downwardly an amount more than a vertical extent of the rigid steel plate but an amount less than a vertical extent of the fiat bottom surface of the elastomeric plate so as to avoid contact between the rail anchor and the concrete railroad tie.

9. The rail anchor assembly of claim 8 wherein the elastomeric plate is formed of a high density polymer.

10. The rail anchor assembly of claim 8 wherein the rail anchor has a generally rectangular cross section and wherein a bottom surface of the center portion extends downwardly from the top surface of the rigid plate supporting the railroad rail no more than 1.0 inches (2.5 cm).

* * * * *